US006895789B2

(12) United States Patent
Masseth, Jr. et al.

(10) Patent No.: US 6,895,789 B2
(45) Date of Patent: May 24, 2005

(54) LOCKABLE LATCH WITH CATCH FOR A SAFE

(75) Inventors: James E. Masseth, Jr., Henrietta, NY (US); David A. Nowicky, Fairport, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 0 days.

(21) Appl. No.: 10/268,849

(22) Filed: Oct. 10, 2002

(65) Prior Publication Data

US 2004/0069023 A1 Apr. 15, 2004

(51) Int. Cl.[7] ..... E05B 65/52

(52) U.S. Cl. ..... 70/63; 70/69; 70/159; 292/122

(58) Field of Search ..... 70/69–76, 102, 70/63, 159, 208, 162; 292/122–124, 56, 129, 194, 229, DIG. 61

(56) References Cited

U.S. PATENT DOCUMENTS

| | | | | | |
|---|---|---|---|---|---|
| 476,575 | A | * | 6/1892 | Sucro | 70/70 |
| 928,904 | A | * | 7/1909 | Cottrell | 70/71 |
| 1,323,709 | A | * | 12/1919 | Madunicky | 70/71 |
| 1,377,770 | A | * | 5/1921 | Hamlin | 70/72 |
| 1,941,150 | A | * | 12/1933 | Meyer | 70/160 |
| 2,113,747 | A | * | 4/1938 | Roedding et al. | 292/127 |
| 2,280,648 | A | * | 4/1942 | Jacobi | 70/71 |
| 2,948,560 | A | * | 8/1960 | Rop | 292/45 |
| 2,956,827 | A | * | 10/1960 | Humphries | 292/99 |
| 3,025,692 | A | | 3/1962 | Cheney | 70/67 |
| 3,106,082 | A | | 10/1963 | Payor et al. | 70/74 |
| 3,401,968 | A | * | 9/1968 | Testa et al. | 292/127 |
| 3,402,578 | A | * | 9/1968 | Atkinson | 70/70 |
| 3,626,730 | A | * | 12/1971 | Murase | 70/70 |
| 3,998,077 | A | | 12/1976 | Bako | 70/74 |
| 4,813,253 | A | | 3/1989 | Dumas | 70/69 |
| 5,077,992 | A | | 1/1992 | Su | 70/107 |
| 5,235,830 | A | * | 8/1993 | Benge | 70/56 |
| 5,257,860 | A | | 11/1993 | Slivon | 312/218 |

* cited by examiner

*Primary Examiner*—Chuck Y. Mah
*Assistant Examiner*—Michael J Kyle
(74) *Attorney, Agent, or Firm*—Jaeckle Fleischmann & Mugel, LLP

(57) ABSTRACT

This lockable latch with catch for use with briefcase type fireproof safes allows the user to carry the safe by its handle (briefcase style) without the lid being locked to the body. It has both a latch and a catch that can pivot or move away from their engagement positions in a plane parallel to, and within, the body of the safe. A release button pivots the latch away from its engagement position and thereby unlatches the latch. Alternatively, a locking member can be interposed so as to prevent the latch from pivoting away from its position of engagement with the catch when the safe is locked. When the locking member is engaged and the latch is thereby locked into engagement position, the ability of the catch to temporarily pivot or move out of the way of the latch still allows the safe lid to snap shut.

7 Claims, 8 Drawing Sheets

LOCKABLE LATCH WITH CATCH FOR A SAFE

TECHNICAL FIELD

Our invention deals with a lockable latch for use with safes, particularly small fireproof safes that can be carried by hand via a handle like a briefcase.

BACKGROUND OF THE INVENTION

The use of a releasable spring-biased latch of the type found on many containers is not common in safe design as most safes are intended for the highest security. They are generally locked and only temporarily unlocked when necessary to access their contents. Thus, there has generally been no need for the expedient of a releasable latch where safes are concerned. However, the new small portable fireproof safes produced by the assignee of this invention have been found to have advantages and requirements different from those typically associated with safes. We believe it would be helpful to provide a releasable latch as well as a lock for use with such safes. However, cost and efficiency weigh against the use of a separate lock and latch for the same safe. Some type of cooperative lock and latch assembly meeting the requirements of safe design is required.

We have found no examples of such assemblies in safe design. However, there are latch and lock combinations in use in other applications. For example, U.S. Pat. No. 3,025,692 issued to Cheney in 1962 deals with "Key-Locked Fastenings for Travel Bags, Boxes and the Like." Likewise, U.S. Pat. No. 3,106,082 issued to Payor et al. in 1963 for a "Lock for Baggage, Etc." teaches a hinged exterior latch member on the lid of a case. Finally, U.S. Pat. No. 3,998,077 issued to Bako in 1976 describes a "Draw Bolt" for use with a case. Cheney, Payor, and Bako disclose case latch arrangements in which an internal catch or catches engage part of a lid-mounted, hinged exterior latch member. To release the latch, the user uses exterior buttons that slide the catch(es) out of engagement with the latch. A lock prevents this operation from taking place. However, exterior latch members are not suitable for use with safes, which require a higher level of security. Moreover, latching in these inventions is not automatically effected by closure. This, once again, adversely affects security and is more inconvenient to the user. Finally, a latch member that swings in a plane perpendicular to the front of the case is not in keeping with the compactness required for a latch of the type we contemplate.

A more sophisticated device for use with a case is disclosed in U.S. Pat. No. 4,813,253 issued to Dumas in 1989 for a "Safety Locking Device for an Article, in Particular Luggage, and an Installation Including Said Device." Dumas teaches a closing device including a rigid planar latch attached to the lid of a case with a pivoting spring-biased planar catch or keeper located in the base. These two elements are set in the same plane and have cam surfaces that enable them to snap together. A button can move the catch element out of the plane of the latch, allowing these parts to disengage, while a lock interposes an element that keeps the catch from sliding out of the plane of the latch and disengaging. The Dumas apparatus avoids most of the problems associated with the prior art devices previously discussed and comes closer to meeting the needs for a portable fireproof safe; however, there remains a need for lockable latches suitable for use in this application.

SUMMARY OF THE INVENTION

Our invention provides a lockable latch with a catch for use with briefcase type fireproof safes that will allow the user to carry the safe by its handle (briefcase style) without the lid being locked to the body. Our lockable latch with catch also holds the lid closed in a fire without being locked, giving the safe greater security as a protective device in case of fire. Our invention also provides the user with greater convenience, as the user need not lock the lid of the safe in order to carry the safe around. Latching is automatically effected by merely closing the lid of the safe and can be accomplished when the safe is in a locked or unlocked condition. Further, none of the elements of our lockable latch with catch are accessible from the exterior of the safe when the safe is closed, providing the security necessary in this application.

In order to meet these goals in a manner that is efficient, economical, and consistent with the needs for ease of use, compactness, and security required by the application, we have developed a lockable latch with catch where both latch and catch can pivot or move away from their engagement positions while remaining in a plane that is parallel to, and within, the body of the safe. Allowing the latch to pivot provides the means for it to be released when desired by the user. The locking member of our invention is interposed so as to prevent the latch from pivoting away from its position of engagement with the catch when our invention is locked. When this member is engaged and the latch is locked into engaged position, the ability of the catch to temporarily pivot or bow out of the way of the latch still allows the safe lid to snap shut.

More specifically, the preferred embodiment of our invention includes the following elements: First, a latch that is pivotally connected to a safe lid, which latch is spring biased towards a catch-engaging position. Second, a release button that can be operated to forcefully pivot the latch away from the catch-engaging position (thereby releasing the latch). Third, a catch that is connected to a safe base, is spring biased towards a latch-engaging position, and engages the latch when the latch is in a catch-engaging position and the catch is in a latch-engaging position. Fourth, a lock that prevents the latch from pivoting away from the catch-engaging position. The lock preferred for use in our invention interposes a member that slides up to block motion of the latch away from the catch-engaging position when locked, forcing the latch to remain in the catch-engaging position. When unlocked, this lock withdraws the member so that the latch is not forced to remain in the catch-engaging position.

DESCRIPTION OF THE INVENTION

Figure 1A:
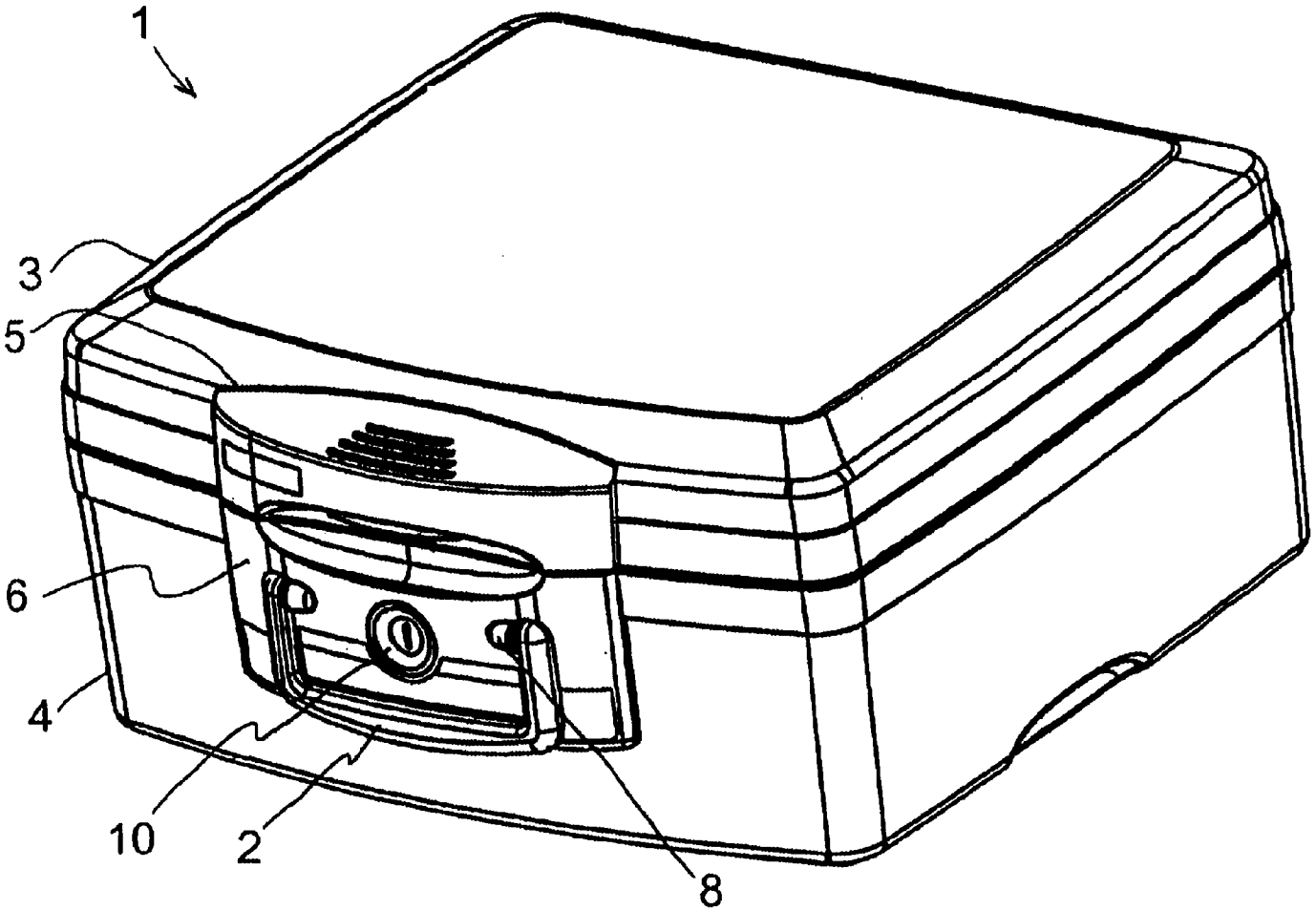
FIG. 1A provides a perspective view from the outside of a closed portable fireproof safe including the lockable latch and catch of our invention.
Figure 1B:
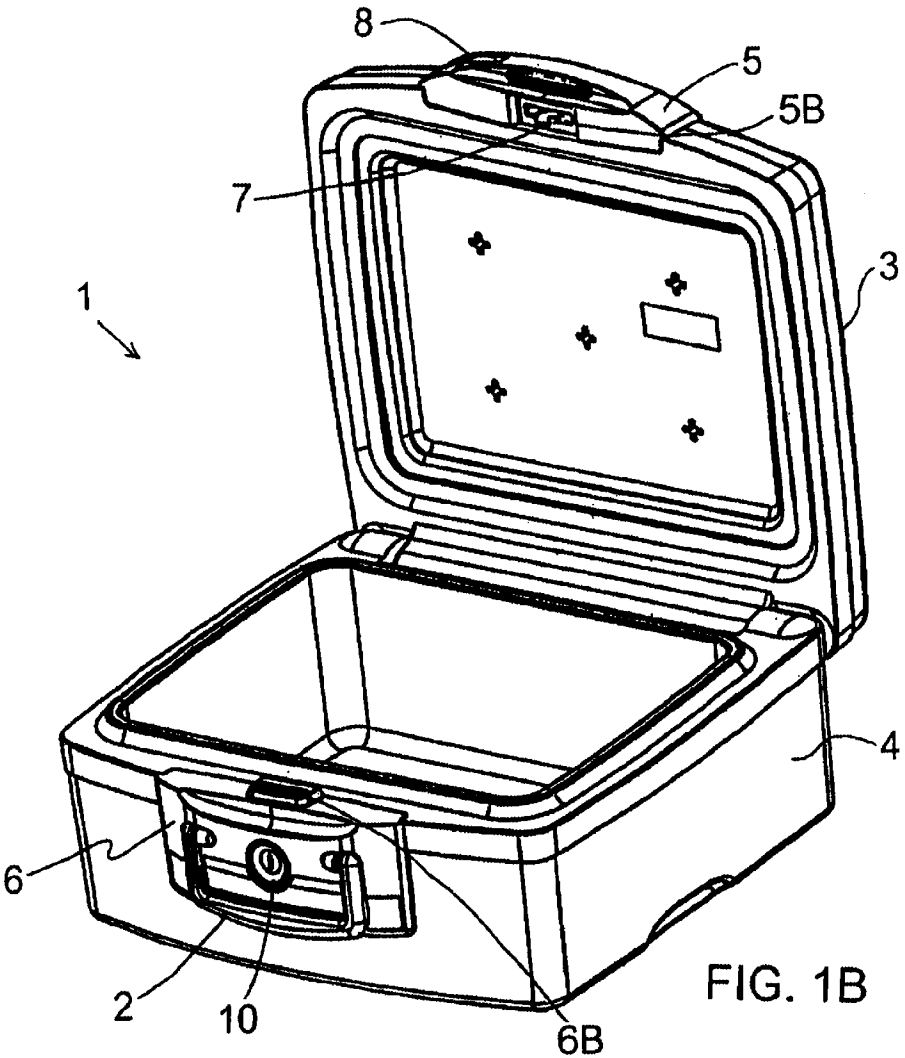
FIG. 1B provides a perspective view from the outside of the portable fireproof safe illustrated in FIG. 1A with its lid open.
Figure 2A:
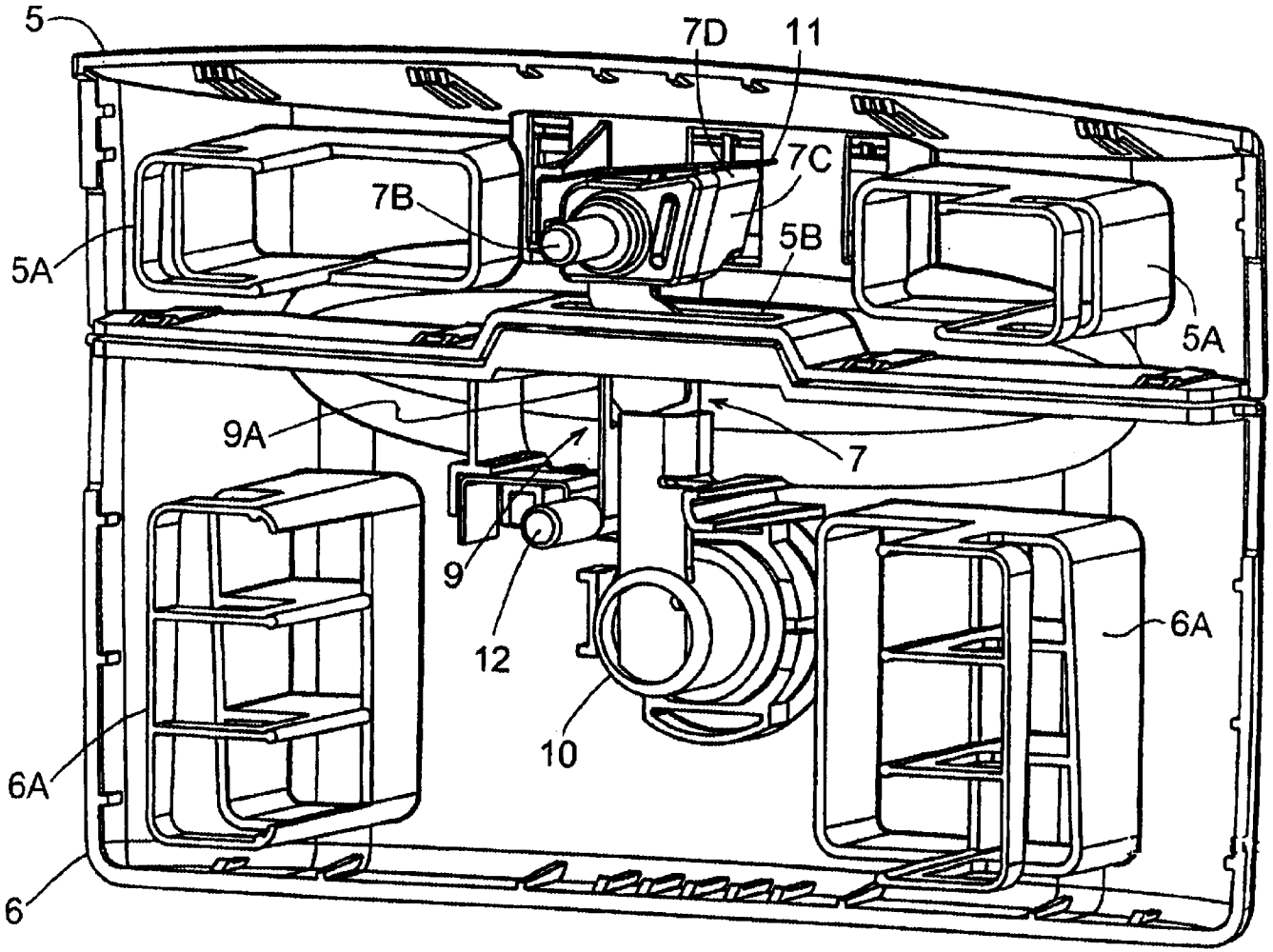
FIG. 2A provides a perspective view from the inside of the upper and lower escutcheon plates of the portable fireproof safe illustrated in FIGS. 1A and 1B with the lockable latch and catch of our invention latched but unlocked.
Figure 2B:
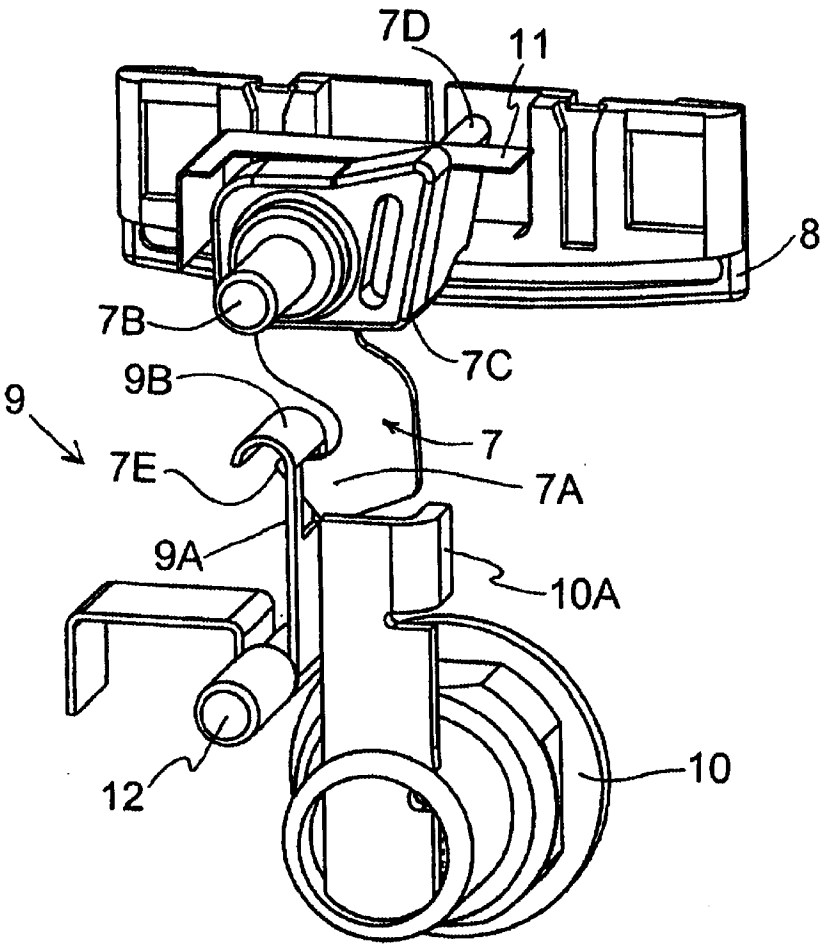
FIG. 2B provides a perspective detailed view of certain elements comprising the lockable latch and catch of our invention in a latched but unlocked configuration.

Our invention is ideal for use with a portable fireproof safe (denoted generally by arrow 1) with handle 2 of the type illustrated in FIGS. 1 and 2. In this application, it can be used to satisfy the objects of our invention, as previously described, by latching/locking together lid 3 and base 4. Lid 3 and base 4 are formed by joining molded interior and exterior skins and filling the space between with a fireproof filler such as concrete. Upper escutcheon 5 and lower escutcheon 6 of this design are affixed in this concrete before it hardens via upper anchors 5A and lower anchors 6A in a manner typical for safes of this general type.

As better seen in the remaining drawing figures, the lockable latch of our invention is affixed within and to molded escutcheons 5, 6. The releasable latch (denoted generally by arrow 7) and release button 8 of our lockable latch are covered by and joined to the upper escutcheon 5 with latch 7 extending through an upper slot 5B in upper escutcheon 5. The catch (denoted generally by arrow 9) and lock 10 for latch 7 are, likewise, covered by and joined to lower escutcheon 6 which has a lower slot 6B for receiving latch 7.

Figure 3A:
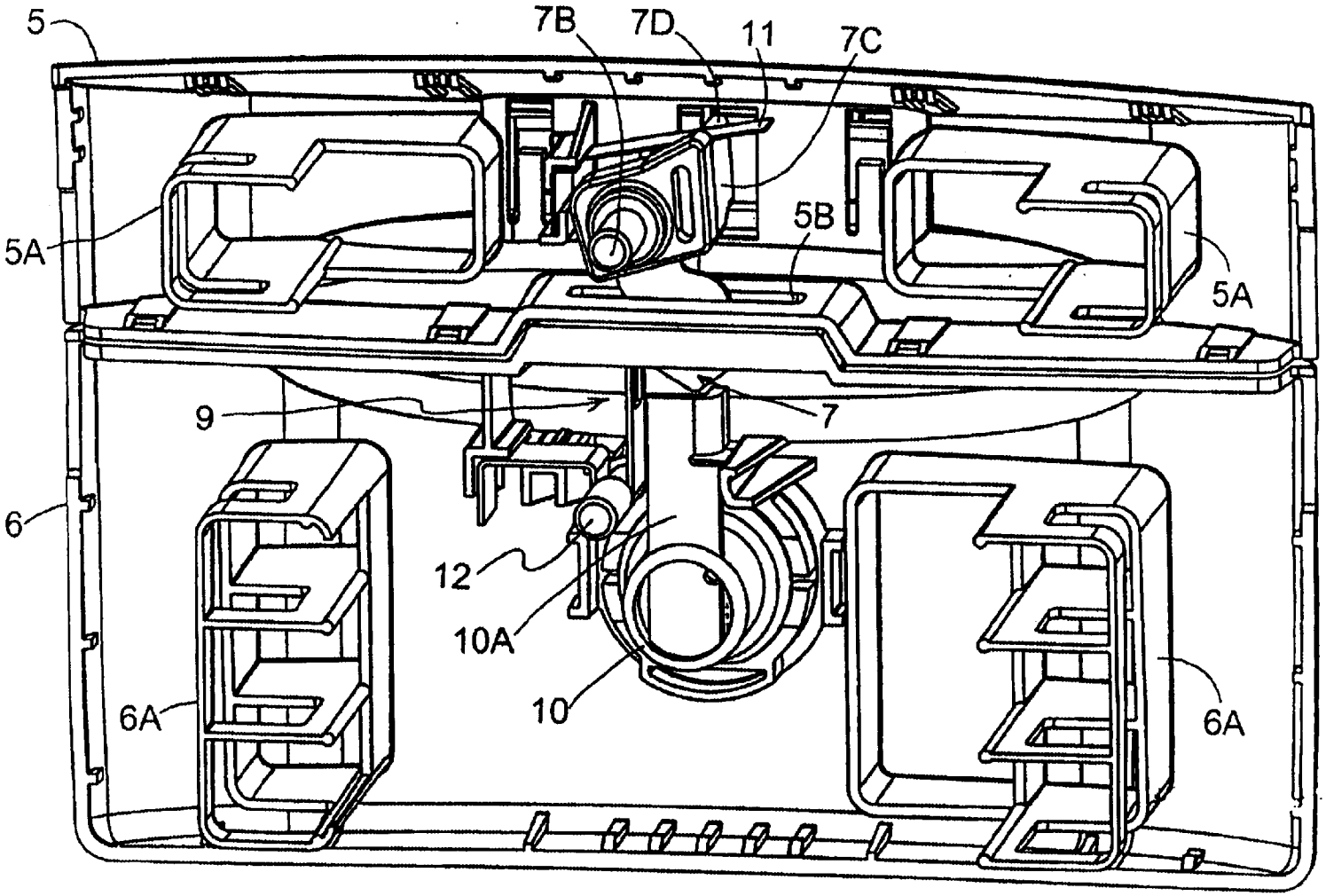
FIG. 3A provides a perspective view from the inside of the upper and lower escutcheon plates of the portable fireproof safe illustrated in FIGS. 1A and 1B with the lockable latch and catch of our invention unlatched and unlocked.
Figure 3B:
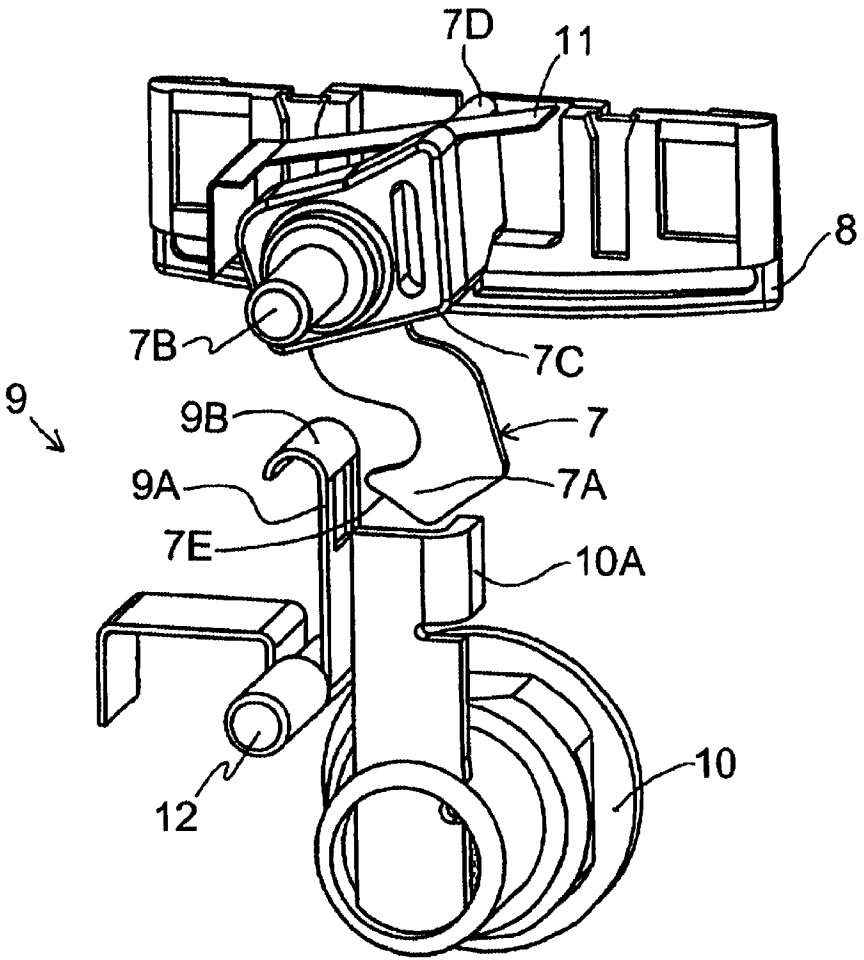
FIG. 3B provides a perspective detailed view of certain elements comprising the lockable latch and catch of our invention in an unlatched and unlocked configuration.

Releasable latch 7 has a latching hook 7A at one end and is pivotally connected via pivot 7B to safe lid 3 at anchor end 7C. (Pivot 7B is anchored directly in the concrete filling safe lid 3 in order to better strengthen and secure the latch/safe lid connection.) Latch 7 is spring biased via a metallic flexure 11 towards a vertical catch-engaging position. (See, e.g., FIGS. 2A and 2B, which show the lockable latch of our invention in a latched but unlocked position.) As better illustrated in FIGS. 3A and 3B, which show our invention in an unlatched position, release button 8 interacts with extension 7D of anchor end 7C such that movement of the button 8 upwards forces extension 7D upwards against the biasing force of metallic flexure 11. This causes latching hook 7A to pivot around pivot 7B away from the catch-engaging position, thereby releasing the latch 7.

Catch 9 is connected to base 4 and has an opening in catch end 9A that engages the latching hook 7A when the latching hook 7A is in a vertical catch-engaging position and catch 9 is in a vertical latch-engaging position. (Catch 9 is shown in latch-engaging position in FIGS. 2A and 2B). Catch 9 can be provided by a rigid edge, ledge, or member of some type. However, in the preferred embodiments illustrated, catch 9 is somewhat flexible, being formed from another metallic flexure. Catch 9 is anchored to and capable of bowing or pivoting around catch pin 12, but is biased towards the vertical latch-engaging position. (Catch pin 12 is also anchored directly in the concrete filling safe body 4 in order to better strengthen and secure the catch/safe body connection.)

The flexibility of both latch 7 and catch 9 serve important needs in our invention. Latch 7 is formed with a ramp edge 7E. Ramp edge 7E serves with either a rigid or flexible catch 9 to help force spring-biased latching hook 7A away from the catch-engaging position sufficiently to snap into engagement with catch end 9A when safe 1 is closed and latch 7 and catch 9 are -brought together. Thus, in a normal unlocked position, without depressing button 8 so as to pivot latching hook 7A away from the catch-engaging position, our safe can snap closed. The flexibility of catch 9 will assist in this process as will the provision of cam surface 9B at the top of catch 9; however, more importantly, both allow and assist our safe in snapping closed when it is locked. The reasons for this will be clearer upon review of the preferred lock 10 for our invention.

Figure 4A:
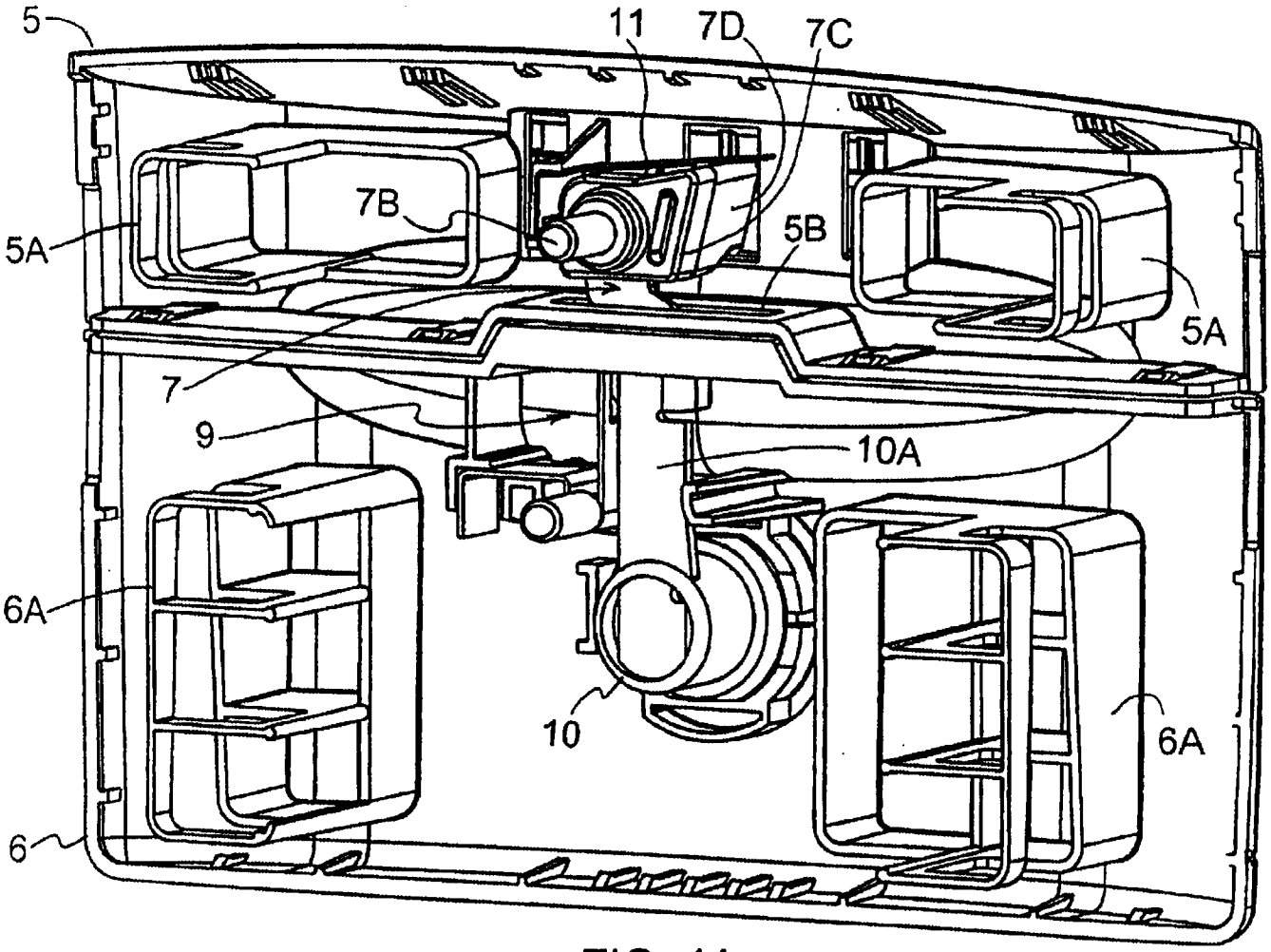
FIG. 4A provides a perspective view from the inside of the upper and lower escutcheon plates of the portable fireproof safe illustrated in FIGS. 1A and 1B with the lockable latch and catch of our invention latched/locked.
Figure 4B:
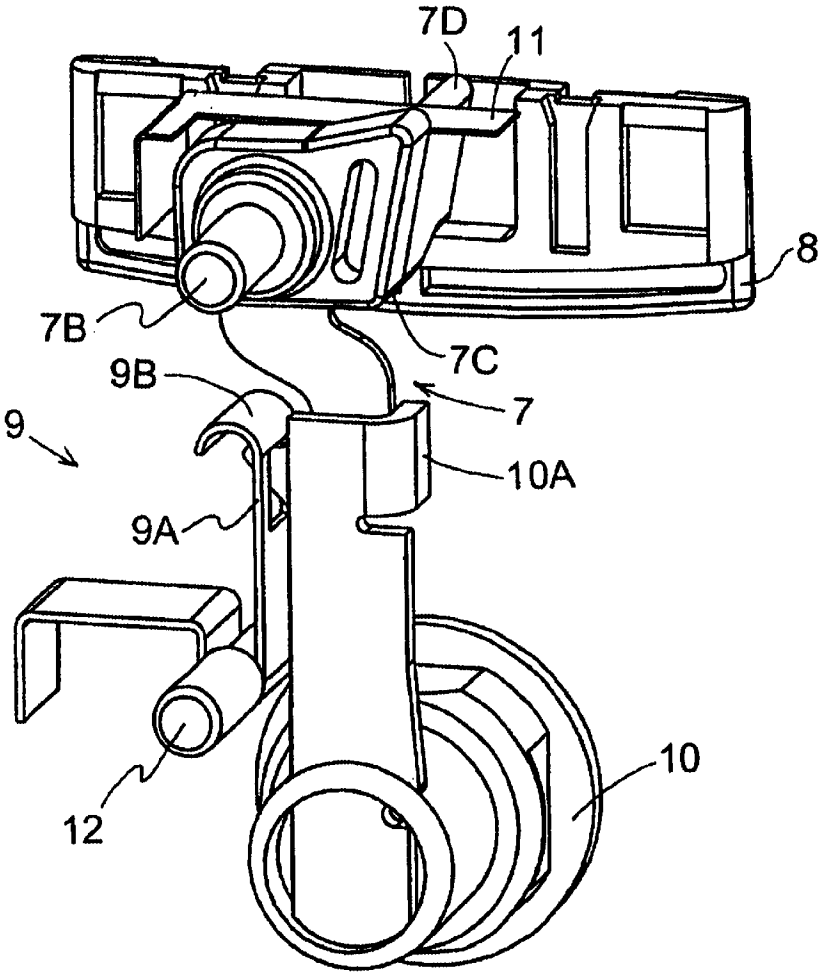
FIG. 4B provides a perspective detailed view of certain elements comprising the lockable latch and catch of our invention in a latched/locked configuration.

The preferred lock 10 for our invention uses a lost motion connection so that rotational motion of the lock cylinder causes translational motion of a vertical member 10A. Member 10A slides up to the position illustrated in FIGS. 4A and 4B when the safe is locked. In this position, member 10A blocks motion of the latch 7 away from the catch-engaging position, forcing the latch 7 to remain in the catch-engaging position. Likewise, when lock 10 is unlocked, this member is withdrawn downward to the position illustrated in FIGS. 2A through 3B so that it no longer forces latch 7 to remain in the catch-engaging position. However, when member 10A is in the locked position, the ability of catch 9 to temporarily pivot or bow out of the way of latch 7 (which is facilitated by cam surface 9B) while remaining in the plane of latch 7 still allows safe lid 3 to snap shut.

Notwithstanding the foregoing description with its accompanying drawings, it should be obvious that numerous variations are possible without exceeding the spirit and scope of our invention. The general ambit and scope of which can be better determined by examination of the claims that follow.

| | |
|---|---|
| 1 | portable fireproof safe |
| 2 | handle |
| 3 | lid |
| 4 | base |
| 5 | upper escutcheon |
| 5B | upper slot |
| 6 | lower escutcheon |
| 6B | lower slot |
| 7 | releasable latch |
| 7A | latching hook |
| 7B | pivot |
| 7C | anchor end |
| 7D | extension |
| 7E | ramp edge |
| 8 | release button |
| 9 | catch |
| 9A | catch end |
| 9B | cam surface |
| 10 | lock |
| 10A | vertical member |
| 11 | metallic flexure |
| 12 | catch pin |

We claim:

1. A lockable latch for a safe, comprising:

a releasable latch, the latch has a latching hook at a hook end and an anchored end that is pivotally connected to a safe such that the latch pivots in a plane substantially parallel to a side of the safe where it is connected, the latch being spring biased towards a catch-engaging position;

a release button, the button can be operated to force the latch to pivot away from the catch-engaging position, thereby releasing the latch;

a catch, the catch is connected to a safe base and engages the latching hook when the latching hook is in the catch-engaging position and the catch is in a latch-engaging position; and a lock, the lock interposes a member that blocks pivoting of the latch away from the catch-engaging position when the lock is in a locked position, forcing the latch to remain in the catch-engaging position, and which lock withdraws the member so that the latch is not forced to remain in the catch-engaging position when the lock is in an unlocked position, wherein the member moves substantially relative to the lock when moving between the locked and unlocked positions.

2. A lockable latch for a safe as described in claim 1, wherein the member moves vertically relative to the lock when moving between the locked and unlocked positions.

3. A lockable latch for a safe, the safe having a lid part and a base part, the lockable latch comprising:

a releasable latch having a latching hook at a hook end and an anchored end that is pivotally coupled with one of the lid part and base part, wherein the latch pivots in a plane substantially parallel to a side of the safe where it is connected;

a flexure element coupled with the latch to bias the latch towards a catch-engaging position;

a release button coupled with the latch to pivot the latch away from the catch-engaging position;

a flexible catch coupled with the opposite part of the safe that the latch is coupled with, the catch having an opening defined therein that engages the latching hook when the latching hook is in the catch-engaging position and the catch is in a latch-engaging position; and a lock having a member that moves substantially linearly relative to the lock when moving between locked and unlocked positions, wherein the member blocks pivoting of the latch away from the catch-engaging position when the lock is in the locked position, and wherein lock withdraws the member so that the latch is not forced to remain in the catch-engaging position when the lock in the unlocked position.

4. A lockable latch for a safe as described in claim 3, wherein the hook end has a ramped edge.

5. A lockable latch for a safe as described in claim 4, wherein the catch has a cam surface that interacts with the ramped edge of the latch.

6. A lockable latch for a safe as described in claim 3, wherein the catch remains in the latch pivot plane when it moves away from the latch-engagement position.

7. A lockable latch for a safe as described in claim 3, wherein the member moves vertically relative to the lock when moving between the locked and unlocked positions.

* * * * *